United States Patent [19]

Hickman

[11] Patent Number: 4,805,912

[45] Date of Patent: Feb. 21, 1989

[54] GOLF PUTTING TEACHING AID

[75] Inventor: Robert D. Hickman, Stroud, Okla.

[73] Assignee: H&F Enterprises, Stroud, Okla.

[21] Appl. No.: 76,375

[22] Filed: Jul. 22, 1987

[51] Int. Cl.[4] ..... A63B 53/04

[52] U.S. Cl. ..... 273/176 FB; 273/176 FA; 273/192; 273/193 R; 273/35 R

[58] Field of Search ..... 273/176 A, 191 R, 176 AA, 273/176 AB, 176 FB, 192, DIG.13, 186 R, 186 C, 35 R, 183 A

[56] References Cited

U.S. PATENT DOCUMENTS

| | | | |
|---|---|---|---|
| 2,750,195 | 6/1956 | Ching | 273/183 |
| 2,894,755 | 7/1959 | Scelzo, Jr. | 273/192 |
| 2,992,005 | 7/1961 | Lockhart | 273/183 |
| 3,332,688 | 7/1967 | Gevertz | 273/186 |
| 3,584,877 | 6/1971 | Florian | 273/176 FB |
| 3,685,833 | 8/1972 | Jack, Jr. | 273/176 FA |
| 3,843,136 | 10/1974 | Buenzle | 273/176 F |
| 3,899,180 | 8/1975 | Rodman | 273/183 |
| 4,017,084 | 4/1977 | Jeffery | 273/176 FB |
| 4,368,888 | 1/1983 | Ren | 273/176 FB |
| 4,544,160 | 10/1985 | Miner | 273/186 C |
| 4,620,708 | 11/1986 | Meyer et al. | 273/192 |

OTHER PUBLICATIONS

Austad's 1987 Early Bird Specials catalog, copyright 1987, p. 26, lower left-hand corner.

Austad's 1987 Early Bird Specials catalog, copyright 1987, p. 27, lower right-hand corner.

*Primary Examiner*—Larry Jones

*Attorney, Agent, or Firm*—Leonard & Lott

[57] ABSTRACT

A golf putting teaching aid for helping a golfer learn proper accelerated putting includes a rectangular putting surface having a putter path line located lengthwise down the center of the putting surface to indicate the proper path of a putter during the putting stroke. A plurality of squaring lines are disposed perpendicular to the putter path at different distances from the cup. These squaring lines serve as a visual aid for the golfer to indicate the proper orientation of the putter head when it strikes the ball, i.e., perpendicular to the path of the golf ball. A stroke length ruler is locatable along an edge of the putting surface and has indicia for aligning the stroke length ruler with the position of the golf ball and for indicating the proper backswing and follow-through in relation to the distance of each putt.

4 Claims, 1 Drawing Sheet

GOLF PUTTING TEACHING AID

TECHNICAL FIELD

This invention relates to golf instruction devices, and more particularly to a putting teaching aide.

BACKGROUND OF THE INVENTION

Many golfers, in spite of practice, remain inconsistent in their putting game. A common mistake some cf the golfers make in their putting game is to strike the golf ball with the head of the putter while the velocity of the putter head is decelerating rather than accelerating. This deceleration generally results in uneven putting strokes because the amount of initial acceleration and subsequent deceleration of the putting head is difficult to control.

A better method of putting is termed accelerated putting. In accelerated putting the ball is struck while the velocity of the putter head is increasing, i.e., the putter head is accelerating. In this type of putting the golfer is required to learn only a single acceleration motion of the putter which is applicable to any length of putter. This acceleration motion is retained, with repetition, as part of the golfer's muscle memory. The distance the ball travels is then determined by the amount of backswing of the putter head. As the backswing is increased, the precontact travel time of the club head, i.e., the time from the beginning of the swing until the ball is struck, also increases, and therefore the velocity of the club head is greater when it strikes the ball than it would be for a shorter backswing.

A second common mistake of some golfers is to stroke the ball with a putter head that is not traveling along the intended path of the golf ball. That is, the golfer may does not swing the putter along the same line as the intended path of the ball, but rather in a path that is oblique to the intended path of the ball. This motion imparts some sideways spin to the golf ball and makes the control of the direction of the putt more difficult.

A third common mistake of some golfers is to stroke the golf ball with the putter head at an oblique angle to the intended path of the golf ball rather than perpendicular to the intended path. This oblique angle causes the golf ball to deviate from the intended travel path of the golf ball.

Therefore, it can be appreciated that a golf putting teaching aid which aids golfers in establishing the proper method of accelerated putting including the proper path of the putter head and the proper orientation of putter head with respect to the golf ball is desirable.

SUMMARY OF THE INVENTION

It is, therefore, an object of this invention to provide a golf putting teaching aid which aids a golfer in establishing a proper accelerated putting technique including the proper path of the putter head and the proper orientation of putter head with respect to the golf ball.

Shown in an illustrated embodiment of the invention is a golf putting teaching aid having a generally rectangular putting surface which includes a line running the length of the putting surface and to a cup to indicate the proper travel path of a putter. The putting surface also has a plurality of squaring lines perpendicular to the lengthwise line to indicate the proper orientation of the putter head. The illustrated golf putting teaching aid also includes a moveable, ruler-like apparatus which has indicia for indicating the proper alignment of the ruler-like apparatus with a selected one of the squaring lines. The ruler-like apparatus also has indicia for indicating the proper length of backswing and follow-through for each of the squaring lines.

BRIEF DESCRIPTION OF THE DRAWINGS

The aforementioned and other features, characteristics, advantages, and the invention in general, will be better understood from the following, more detailed description taken in conjunction with the accompanying drawings in which.

Figures 1, 2:
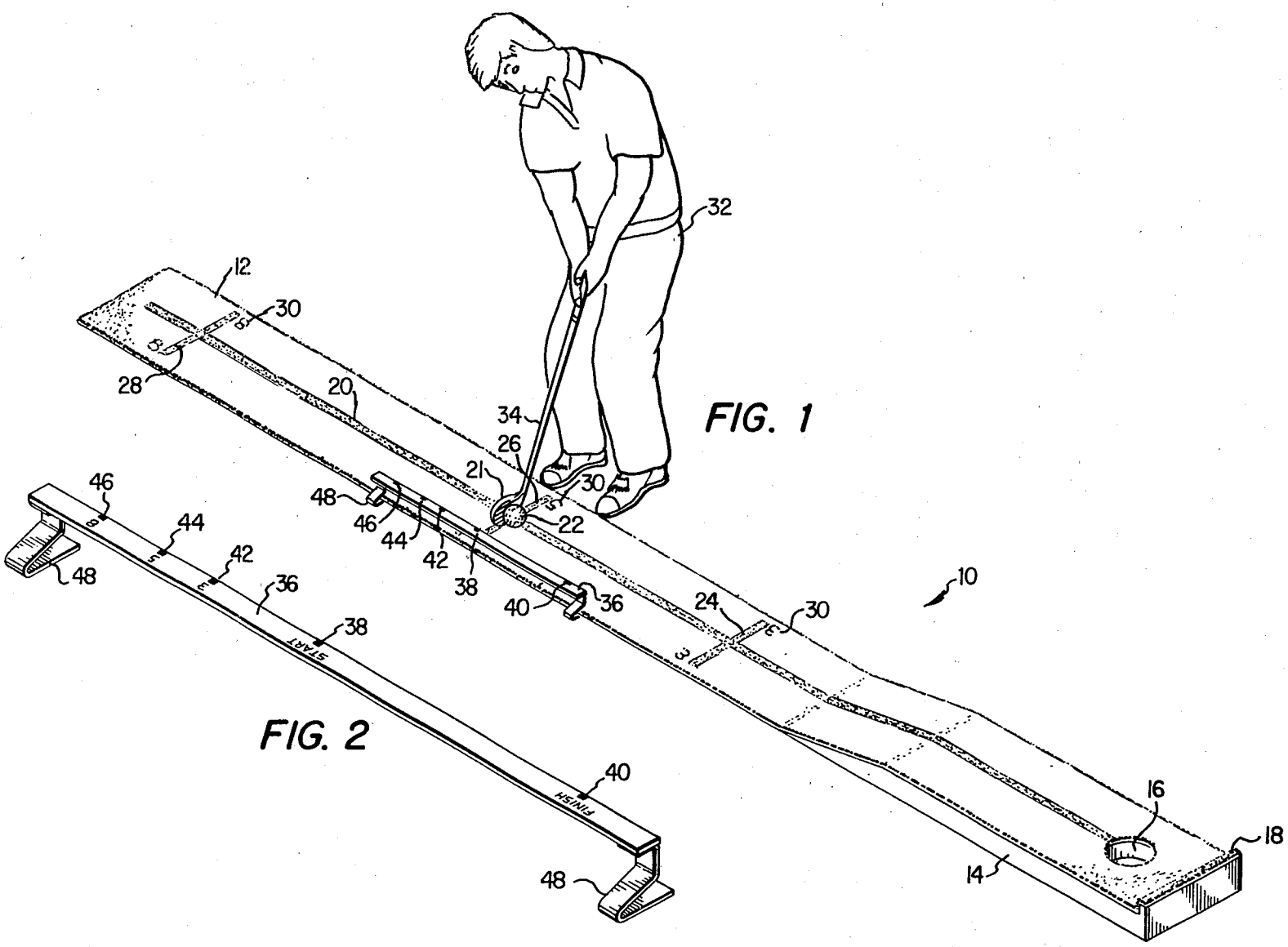
FIG. 1 is a perspective view of a golfer using a golf putting teaching aid according to the present invention.
FIG. 2 is an enlarged perspective view of the stroke length ruler shown in FIG. 1.

It will be appreciated that for purposes of instruction, the accompanying drawings have not necessarily been drawn to scale; and that for clarity and where deemed appropriate, reference numerals have been repeated in the figures to indicate corresponding features.

DESCRIPTION OF THE PREFERRED EMBODIMENT

Turning now to the drawings, a golf putting teaching aid, shown generally as element 10, includes a rectangular putting surface 12. The putting surface 12 in the preferred embodiment is portable and made of green artificial turf, and one end of the putting surface is glued to a foam backing 14. The foam backing 14 is sufficiently thick to include a cup 16 formed therein, and one end of the foam backing 14 is slanted to provide a gentle rise in the putting surface 12 to the cup 16. Attached to the short end of the putting surface 12 near the cup is a back stop 18 which rises straight up from the putting surface to keep golf balls from traveling past the end of the putting surface 12.

A putter path line 20 is formed lengthwise down the center of the putting surface to the cup 16 to indicate the proper travel path of a putter head 21 during a putting stroke and the proper travel path of a golf ball 22. Disposed perpendicular to the putter path line 20 are a plurality of squaring lines 24, 26, and 28 which indicate the proper line of the putter head 21 when it strikes the golf ball 22. The first squaring line 24 is located approximately 3 feet from the cup 16 in the preferred embodiment. The squaring line 26 is located approximately 5 feet from the cup 16, and the squaring line 28 is located approximately 8 feet from the cup 16. These distances are indicated on the rectangular putting surface 12 by number, shown as element number 30 in FIG. 1, to indicate to the golfer 32 the approximate distance of each of the squaring lines to the cup 16. For example, in FIG. 1 the golfer 32 has positioned the golf ball 22 on the squaring line 26 which is approximately 5 feet from the cup 16. The golfer 32 is shown with a putter 34, the putter head 21 being in contact with the golf ball 22.

Included in the present invention is a stroke length ruler 36 shown in FIG. 1 and also shown in detail in FIG. 2. Turning now to FIG. 2, the stroke length ruler 36 contains a plurality of indicia indicating a start mark 38, a finish or follow-through mark 40 and a plurality of backswing marks: a "3" mark 42, a "5" mark 44, and an "8" mark 46. The stroke length ruler 36 also has two support members 48 which hold the stroke length ruler 36 slightly above the putting surface 12 but which are not attached to the putting surface 12 in order that the stroke length ruler 36 may be moved or slid along one edge of the putting surface 12.

In operation the golfer 32 would choose one of the three distances from which to practice his putting stroke: 3 feet as indicated by the squaring line 24, 5 feet as indicated by the squaring line 26, or 8 feet as indicated by the squaring line 28. In the placement shown in FIG. 1, the golf ball 22 is placed at the 5 foot squaring line 26. The stroke length ruler 36 is then properly aligned by placing the start mark 38 in line with the 5 foot squaring line 26.

The golfer 32 would first position the putter head 21 so that the face of the putter head is in line with the squaring line 26 in order that the putter head 21, when it strikes the golf ball 22, will be perpendicular to the intended travel path of the golf ball 22. The golfer 32 would then bring the putter head 21 back along the putter path line 20 to the "5" mark 44 and begin the swing with a motion of the putter 34 to cause the putter head 21 to follow the putter path line 20 and to increase in velocity until the golf ball 22 is stroked by the putter head 21. The golfer 32 would continue the swing or follow-through until the putter head 21 is approximately in line with the finish mark 40 on the stroke length ruler 36.

If the golfer 32, instead, wishes to practice 3 foot putts, he would place the golf ball 22 on the 3 foot squaring line 24 and would align the start mark 38 of the stroke length ruler 36 with the 3 foot squaring line 24. The golfer 32 would then bring the putter head 21 back to a position in line with the "3" mark 42 on the stroke length ruler 36. He would then begin his stroke of the ball from this position and, using the same putter path, putter head orientation, force and acceleration on the putter 34 as used for the 5 foot putt, would swing and strike the golf ball 22 and continue the follow-through motion until the putter head 21 is approximately in line with the finish mark 40 on the stroke length ruler 36. Similarly, if the golfer 32 wishes to practice 8 foot putts, he would place the golf ball 22 on the 8 foot squaring line 28 and align the start mark 38 on the stroke length ruler 36 with the 8 foot squaring line 28. He would pull the putter head 21 back to a position approximately in line with the "8" mark 46 on the stroke length ruler 36 and begin his stroke from that position. He would use the same putter path, putter head orientation, and acceleration on the putter head 21 as he used for the 3 foot and the 5 foot putts, and would follow through to approximately the same finish mark 40 on the stroke length ruler 36.

An advantage of the golf putting teaching aid of the present invention is that it provides a complete teaching aid for the theory of accelerated putting. That is, it teaches the golfer the proper use of accelerated putting so that the golfer need learn and retain in muscle memory only a single acceleration motion of the putter together with proper eye training to orient the putter head 21 perpendicular to the intended travel path of the ball, and to teach the golfer 32 to swing the putter 34 along the same line as the intended travel path of the ball. The finish mark 40 encourages the golfer 32 to continue to follow through on each stroke rather than to tap the golf ball since tapping the golf ball is inconsistent with the proper accelerated putting technique.

The start mark 38 is approximately 10 inches from the finish mark 40 in the preferred embodiment. In the opposite direction, the start mark 38 is approximately 4 inches from the "3" mark 42, approximately 5¾ inches from the "5" mark 44, and approximately 8 inches from the "8" mark 46 in the preferred embodiment.

Although the invention has been described in part by making detailed reference to a certain specific embodiment, such detail is intended to be and will be understood to be instructional rather than restrictive. It will be appreciated by those skilled in the art that many variations may be made in the structure and mode of operation without departing from the spirit and scope of the invention, as disclosed in the teachings contained herein.

What is claimed is:

1. A golf putting teaching aid comprising:

(a) a generally rectangular putting surface;

(b) a putter path line running lengthwise on said putting surface;

(c) a plurality of squaring lines on said putting surface, each of said squaring lines disposed perpendicular to said putter path line; and (d) a moveable, ruler-like apparatus disposed along an edge of said putting surface, said ruler-like apparatus having indicia means for indicating the proper alignment of said ruler-like apparatus with each of said squaring lines, and for indicating the length of backswing for each of said squaring lines.

2. A golf putting teaching aid as set forth in claim 1 wherein said rectangular putting surface further includes a cup for receiving a golf ball.

3. A golf putting teaching aid as set forth in claim 1 wherein said indicia means further includes means for indicating the length of follow-through for each of said squaring lines.

4. A golf putting teaching aid for use with accelerated putting comprising:

(a) a substantially rectangular, artificial turf putting surface having a cup disposed in one end thereof;

(b) a putter path line located lengthwise on said putting surface;

(c) a plurality of squaring lines located on said putting surface and oriented perpendicular to said putter path line; and (d) a moveable, ruler-like apparatus locatable along an edge of said putting surface and parallel to said putter path line, said ruler-like apparatus having a plurality of marks therein, said marks comprising:

(i) a reference mark for aligning said ruler-like apparatus with one of said plurality of squaring lines;

(ii) a single mark indicating the proper length of a follow-through stroke for putting a golf ball when said reference mark on said ruler-like apparatus is aligned with any of said plurality of squaring lines located on said putting surface; and (iii) a plurality of backswing marks, each of said plurality of backswing marks corresponding to one of said squaring lines for indicating the proper length of backswing for putting said golf ball when it is positioned on said corresponding said squaring line.

* * * * *